US010144019B2

(12) United States Patent
Giovannini

(10) Patent No.: US 10,144,019 B2
(45) Date of Patent: Dec. 4, 2018

(54) METHOD AND APPARATUS FOR FLAME SPRAYING THERMOPLASTIC POWDERS

(71) Applicant: IBIX S.R.L., Santa Maria in Fabriago (IT)

(72) Inventor: Susanna Giovannini, Santa Maria in Fabriago (IT)

(73) Assignee: IBIX S.R.L., Santa Maria in Fabriago (IT)

( * ) Notice: Subject to any disclaimer, the term of this patent is extended or adjusted under 35 U.S.C. 154(b) by 0 days.

(21) Appl. No.: 15/029,058

(22) PCT Filed: Oct. 13, 2014

(86) PCT No.: PCT/IB2014/065268

§ 371 (c)(1),
(2) Date: Apr. 13, 2016

(87) PCT Pub. No.: WO2015/056153

PCT Pub. Date: Apr. 23, 2015

(65) Prior Publication Data

US 2016/0256879 A1 Sep. 8, 2016

(30) Foreign Application Priority Data

Oct. 14, 2013 (IT) ..... BO2013A0560

(51) Int. Cl.
*B05B 7/20* (2006.01)
*C23C 4/129* (2016.01)
(Continued)

(52) U.S. Cl.
CPC ..... *B05B 7/205* (2013.01); *B05B 7/0869* (2013.01); *B05D 1/10* (2013.01); *B05D 1/12* (2013.01);
(Continued)

(58) Field of Classification Search
CPC ..... B05B 7/205; B05B 7/0869; B05B 15/002; B05B 7/1486; B05B 15/0431; B05C 5/02;
(Continued)

(56) References Cited

U.S. PATENT DOCUMENTS 2,741,508 A * 4/1956 Marantz ..... B05B 7/168 239/597
3,159,348 A * 12/1964 Wedan ..... B05B 7/08 239/290

(Continued)

FOREIGN PATENT DOCUMENTS

| | | | |
|---|---|---|---|
| EP | 0 533 417 | A1 | 3/1993 |
| IT | BO2009A000292 | A1 | 11/2010 |
| WO | 00/29635 | A2 | 5/2000 |

*Primary Examiner* — Laura Edwards
(74) *Attorney, Agent, or Firm* — McGlew and Tuttle, P.C.

(57) ABSTRACT

The method for flame spraying thermoplastic powders provides to heat the article to be coated at a suitable working temperature and to feed the said thermoplastic powders, transported by an inert gas, a flow of compressed air and a flow of liquefied petroleum gas through respective separated discharge chambers (7, 9, 12), shaped inside a mixing device (1) of a spray gun. The thermoplastic powders are then projected, in a resulting flow (30), on the heated surface of the article to be coated, to determine the melting of the same powders at their contact with said heated surface. At least one couple of flows (31, 32) of compressed air is sprayed converging towards the resulting flow (30) flowing out of the mixing device (1), giving the resulting flow (30) a substantially flattened fan shape.

11 Claims, 3 Drawing Sheets

(51) Int. Cl.

| | |
|---|---|
| ***B05B 7/08*** | (2006.01) |
| ***B05D 1/10*** | (2006.01) |
| ***B05D 3/08*** | (2006.01) |
| ***B05D 1/12*** | (2006.01) |
| *B05B 7/14* | (2006.01) |
| *B05B 12/18* | (2018.01) |
| *B05B 15/20* | (2018.01) |

(52) U.S. Cl.
CPC ..... *B05D 3/08* (2013.01); *C23C 4/129* (2016.01); *B05B 7/1486* (2013.01); *B05B 12/18* (2018.02); *B05B 15/20* (2018.02)

(58) Field of Classification Search
CPC ..... B05C 11/1042; B05C 5/001; B05C 9/14; B05C 19/00; B05D 1/12; B05D 3/08; B05D 1/10; C23C 4/129
USPC ..... 239/79, 85, 290, 434.5; 118/47; 427/446
See application file for complete search history.

(56) References Cited

U.S. PATENT DOCUMENTS

| | | | | |
|---|---|---|---|---|
| 3,198,434 | A | 8/1965 | Svrchek et al. | |
| 5,282,573 | A * | 2/1994 | Reimer | B05B 7/1404 137/891 |
| 2008/0041979 | A1 * | 2/2008 | Gardega | B05B 7/1472 239/549 |
| 2008/0060574 | A1 | 3/2008 | Bacchus et al. | |

* cited by examiner

METHOD AND APPARATUS FOR FLAME SPRAYING THERMOPLASTIC POWDERS

TECHNICAL FIELD

The present invention concerns a method and an apparatus for flame spraying thermoplastic powders.

BACKGROUND ART

It has long been known the technique of coating by flame spraying thermoplastic powders applied by melting. Such technique is used for example for the production of anti-corrosive coatings on manufactured articles of different nature.

According to a known method, the thermoplastic powders are sprayed on the manufactured article to be coated by means of a spray gun fed with compressed air and with a suitable liquefied petroleum gas. The gas flame produced by the spray gun transfers the melted particles of the powders on the article to be coated.

The method of coating by flame spraying is of rapid and economic use and is adapted for coating different materials. The apparatuses currently used to obtain such coating, however, have certain drawbacks which limit their performance and thus make the use of the aforementioned method less effective.

In particular, it is often complained the fact that the spray gun is subject to overheating during use. This may, inter alia, adversely affect the physical characteristics of the powders to be applied.

To solve this problem, patent application ITBO2009A000292 in the name of the applicant discloses a method for flame spraying thermoplastic powders which provides in particular to heat, firstly, the surface to be coated, and then mix the thermoplastic powders with an inert carrier gas, and project it through compressed air and/or nitrogen against the heated surface. The method also provides to feed a flow of liquefied petroleum gas for the production of a flame so as to maintain the surface to be coated at the desired temperature. Such patent application also discloses an apparatus adapted to carry out the above mentioned method, which provides in particular a spray gun provided with a mixing device, inside which the thermoplastic powders, the compressed air and the liquefied petroleum gas are mixed. The mixing device comprises three outlet chambers separated for each of the above mentioned components.

However, this solution still presents some drawbacks. In particular, it does not allow a perfectly homogeneous spraying of the thermoplastic powders on the surface of the article to be coated.

In fact, such solution provides a radially symmetrical flow, flowing out of the mixing device, in particular having a conical-cylindrical shape, not always uniform. The result is the formation on the processed article of accumulations of powders, concentrated on strips, under which pockets of air can also be trapped. These air pockets, besides giving a visual unattractive appearance to the coated article, also involve the risk of creating a non-continuity of the coating, which could lead to poor impact resistance and thus to a considerable fragility of the coating.

DISCLOSURE

The task of the present invention is that of solving the aforementioned problems, devising a method for flame spraying thermoplastic powders which is able to ensure a perfect uniformity of the spraying of the powders.

Within such task, it is a further scope of the present invention to provide an apparatus for flame spraying thermoplastic powders which is able to carry out the above mentioned method.

Another scope of the invention is to provide an apparatus for flame spraying thermoplastic powders which eases the coating operations for the user, and makes such operations quicker and better.

A further scope of the invention is to provide an apparatus for flame spraying thermoplastic powders of simple constructive and functional conception, provided with surely reliable functioning, versatile use as well as relatively economic cost.

The cited scopes are achieved, according to the present invention, by the method and by the apparatus for flame spraying thermoplastic powders according to the present invention.

In particular, the method according to the invention provides to spray at least one couple of flows of compressed air and/or nitrogen in a direction converging towards the flow of thermoplastic powders flowing out of the mixing device of the spray gun, to modify the shape of the flow of the projected thermoplastic powders.

In a particularly advantageous way, the method according to the invention provides to spray a couple of flows of compressed air and/or nitrogen converging towards the flow of projected thermoplastic powders, such converging flows originating from axially spaced points and directly opposite with respect to the flow of projected thermoplastic powders, so as to give the flow of projected thermoplastic powders a flattened shape, substantially fan-shaped.

According to another advantageous aspect of the invention, the method provides, after the step of mixing the thermoplastic powders with the transport inert gas, to feed the thermoplastic powders transported by the inert gas through an homogenization member of the flow provided with a helical axial element, so as to homogenize the flow of thermoplastic powders before its feeding through the mixing device.

Similarly, the present invention discloses ad apparatus which is able to carry out the above mentioned method. Such apparatus comprises in particular a spray gun provided with a mixing device having separated discharge chambers and through which the thermoplastic powders transported by an inert gas, the compressed air and/or nitrogen and a flammable gas are fed. More in particular, the mixing device comprises at least one couple of inclined and convergent elements for spraying respective flows of compressed air and/or nitrogen towards the flow of thermoplastic powders projected outwardly from the same mixing device, to modify its shape.

More in particular, the mixing device comprises expulsion means for a flow of compressed aid and/or nitrogen; expulsion means for said flammable gas to shape a flame; said inclined spraying elements being radially arranged between said expulsion means of a flow of compressed air and/or nitrogen and said expulsion means for said flammable gas.

According to a particularly advantageous aspect, the mixing device comprises two inclined elements for the spraying of two respective flows of compressed air and/or nitrogen towards the flow of projected thermoplastic powders, the above mentioned two inclined elements being arranged in diametrically opposed positions with respect to the opening for the exit of the flow of projected thermoplastic powders.

According to a further aspect of the invention, the apparatus for flame spraying thermoplastic powders comprises a homogenization member of the flow arranged upstream of the mixing device and through which the flow of thermoplastic powders transported by the inert gas is fed, the homogenization member being provided with a helical axial element configured to homogenize the flow of thermoplastic powders.

DESCRIPTION OF DRAWINGS

Details of the invention shall be more apparent from the detailed description of a preferred embodiment of the apparatus for flame spraying thermoplastic powders according to the invention, illustrated for indicative purposes in the attached drawings, wherein.

BEST MODE

Figure 1:
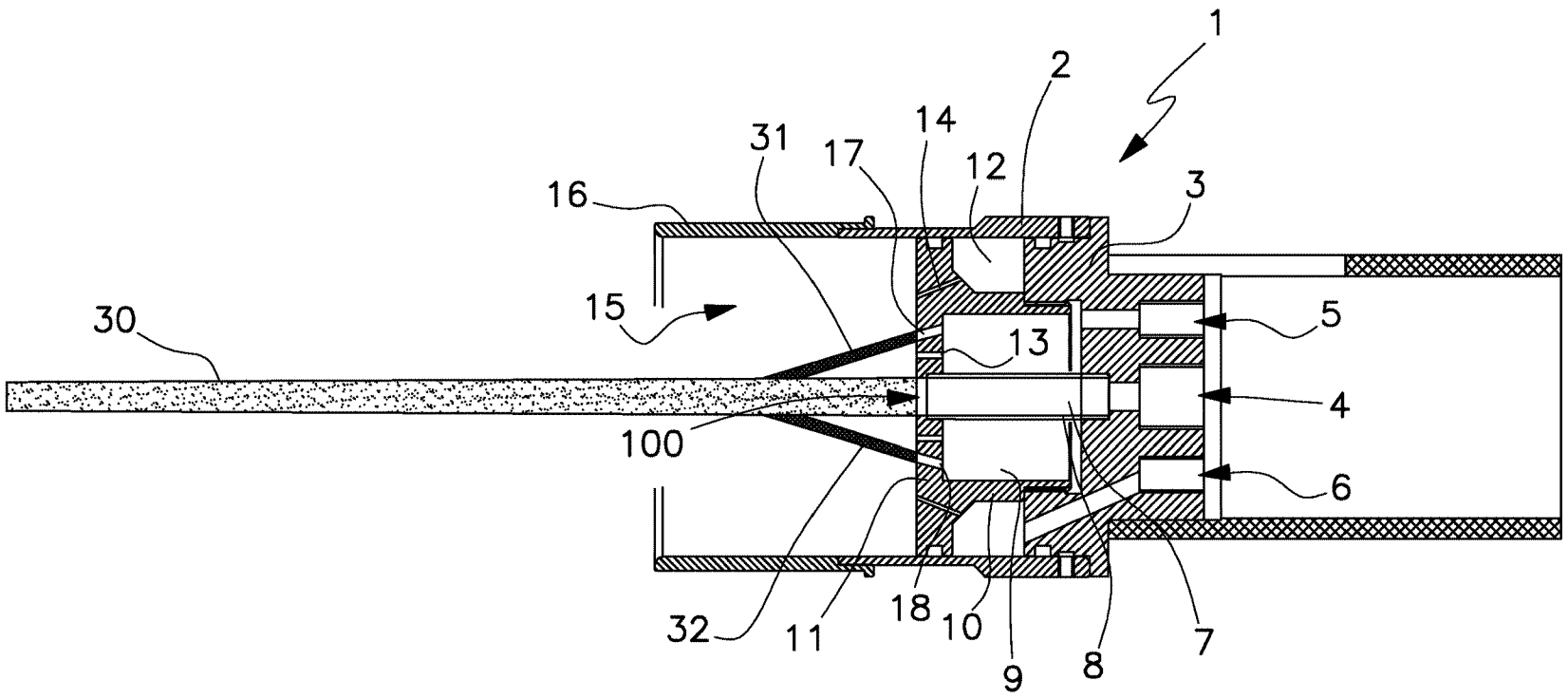
FIG. 1 shows a lateral section view of the spray gun according to the present invention.

With particular reference to such figures, the mixing device associated with the spray gun of the apparatus for flame spraying thermoplastic powders according to the invention has been indicated in its entirety with 1.

The mixing device 1 is made up of a body 2 of tubular shape carrying, at a rear edge, a sealed head element 3, in which there is a feed means for the thermoplastic powders, comprising a first duct 4 for the feeding of the thermoplastic powders transported by an inert gas, a second duct 5 for the feeding of a flow of compressed air and a third duct 6 for the feeding of a flammable gas, in particular liquefied petroleum gas or GPL, of the type for example of propane gas. As an alternative, it is possible to feed through the second duct 5 a mixture of air and nitrogen or possibly only nitrogen. Obviously, it is possible to provide the use of different gas according to the exigencies, also in mixtures, for example a mixture of propane and butane.

It is to be noted that a resulting flow 30, obtained through the combination of at least the flow of thermoplastic powders transported by the inert gas with the flow of compressed air and/or nitrogen, flows out of such mixing device 1.

In known way, the air is fed to the spray gun through an air compressor, of known type, not represented in figures, through a relative piping; the propane is fed to the spray gun through a suitable air cylinder not represented, through a relative piping. Obviously, the piping of the air compressor and of the air cylinder of the propane are provided with suitable members for the adjustment of the outflow.

The first duct 4 for the feeding of the powders is connected with a first discharge chamber 7 shaped by a tubular element 8 arranged according to the longitudinal axis of the body 2. The thermoplastic powders are fed to the duct 4 by a known suitable load container not represented, through a relative piping 20, by means of the interposition of a member, so called Venturi meter, adapted to cause the controlled release of the same powders, it is possible to provide, instead of the Venturi meter, a feed device provided with a suitable mixing valve.

The second duct 5 for the feeding of the mixture of air and/or nitrogen is connected with a second discharge chamber 9 shaped by a sleeve 10 externally coaxial to the tubular element 8. The second discharge chamber 9 is therefore shaped in annular shape between the inner surface of the sleeve 10 and the above mentioned tubular element 8.

The sleeve 10 is firmly coupled, at a rear edge, with the head element 3 of the device, while at the front edge it shapes a front flange 11 which is associated, with sealing, with the inner surface of the body 2. Between such inner surface of the body 2 and the sleeve 10, a third discharge chamber 12 is shaped which is in communication with the third duct 6 for the feeding of the propane gas.

The tubular element 8 is constrained at its opposite ends respectively to the head element 3 and to the front flange 11, the front flange being provided with a suitable axial opening 100, through which the resulting flow 30 of projected thermoplastic powders is sprayed.

The front flange 11 bears, passing through, a diffusion means 13 for a flow of compressed air and/or nitrogen, for example a first series of nozzles 13 and a diffusion means 14 for said flammable gas, for example a second series of nozzles 14 configured to put in contact respectively the second discharge chamber 9 and the second discharge chamber 12 with a mixing chamber 15 shaped frontally to the same front flange 11. Such mixing chamber 14 extends inside an annular sleeve 16 frontally inserted on the body 2.

Preferably, said first series of nozzles 13 and said second series of nozzles 14 are arranged along respective circumferences concentric with respect to the longitudinal axis of the tubular element 8.

According to the present invention, the mixing device 1 comprises at least one couple of spraying element 17, 18 inclined so as to direct respective flows 31, 32 of compressed air and/or nitrogen in a direction converging to the resulting flow 30 of projected thermoplastic powders flowing out of the same mixing device 1. Each of such spraying elements 17, 18 is preferably made up of a hole obtained passing on the front flange 11 in a position such to connect the second discharge chamber 9 with the mixing chamber 15. As an alternative, it is possible to provide that the spraying elements 17 are made up of nozzles, deflector elements or any type of spraying element which is able to spray a flow of compressed air and/or nitrogen.

More in detail, each of said inclined holes 17, 18 is arranged in a position axially spaced with respect to the axis of the tubular element 8, and at a distance from the axis which is bigger than the radius of the circumference on which the above mentioned first series of nozzles 13 is arranged, as it can be seen in FIG. 1.

The axis of each inclined hole 17, 18 has a direction converging with respect to the axis of the tubular element 8, preferably shaping an angle comprised between 10° and 20° C., and, according to a preferred embodiment, substantially equal to 15° C.

According to the preferred embodiment of the invention, the mixing device 1 comprises two inclined spraying elements 17, 18, as it is possible to see in FIG. 1. Such inclined spraying elements 17, 18 are made up of suitable holes passing through the front flange 11 in a position such to connect the second discharge chamber 9 with the mixing chamber 15. The two inclined spraying elements 17, 18 are arranged in symmetrically opposite positions on a concentric circumference. Such circumference has a diameter bigger than the circumference on which the first series of nozzles 13 is arranged and a diameter smaller than the circumference on which the second series of nozzles 14 is arranged.

Figure 2:
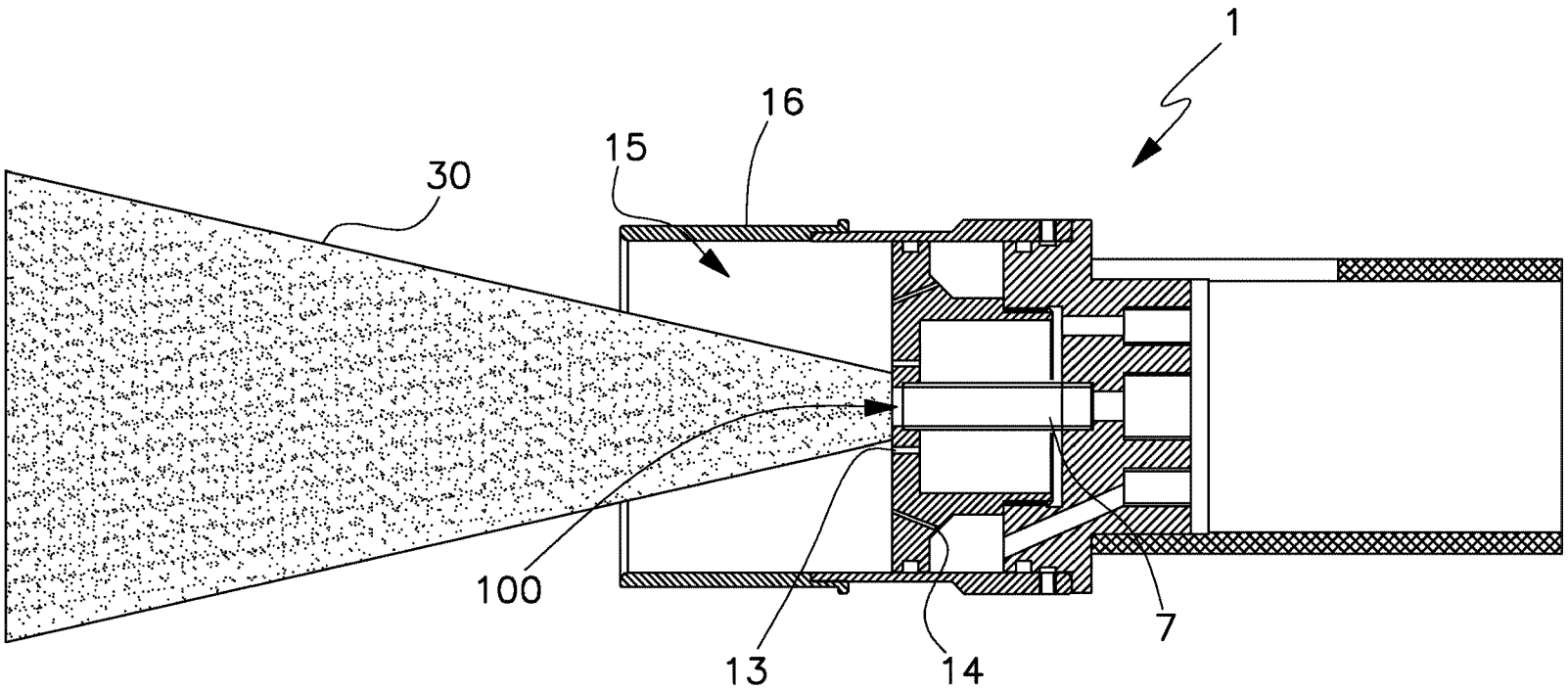
FIG. 2 shows a plant and section view of the gun of FIG. 1.

Therefore, the above mentioned inclined holes 17, 18 are arranged reciprocally symmetric with respect to the axial hole of the front flange 11, so as to spray respective inclined flows 31, 32 of compressed air and/or nitrogen on the resulting flow 30 of thermoplastic powders projected outwardly from the mixing device 1, and thus to give the resulting flow 30 a flattened shape substantially similar to a fan, as it is shown in FIGS. 1 and 2. Such effect is due to the compression action exerted by the converging flows 31, 32 on the flow 30.

Obviously, it is possible to provide a higher number of inclined elements according to the shape of the resulting flow 30 of thermoplastic powders to be obtained.

Figure 3:
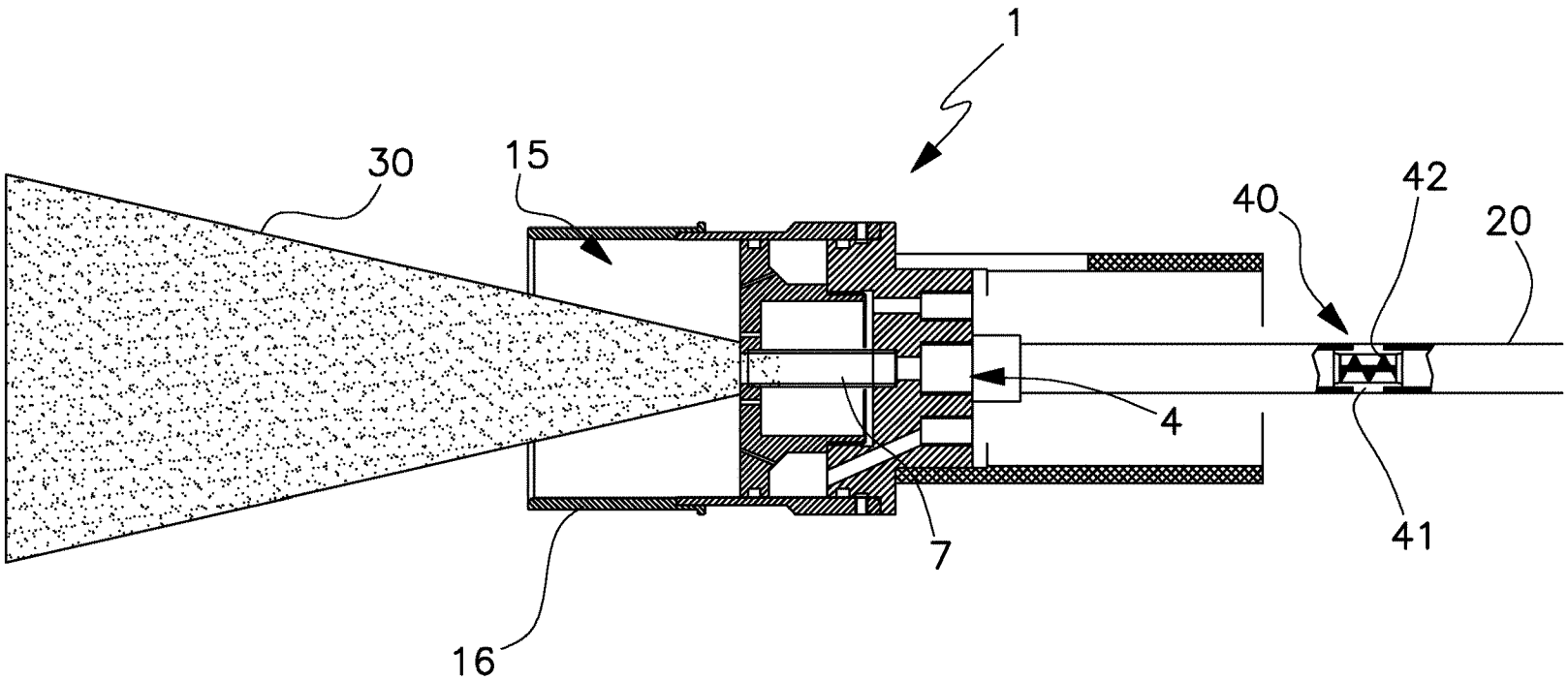
FIG. 3 shows a lateral view of a variant of the gun according to the invention.

According to a specific embodiment of the apparatus according to the invention represented in FIG. 3, the cited piping 20 for the feeding of the flow of thermoplastic powders transported by the inert gas is provided with a homogenization member 40 for the flow, arranged axially to it. The homogenization member 40 comprises a tubular body 41 and a helical axial element 42.

The functioning of the gun for flame spraying thermoplastic powders is easy to understand from the preceding description.

Firstly, the article to be coated is heated to a suitable working temperature, for example comprised between 90° and 100° C. The working temperature essentially depends on the melting point of the used powders and therefore it can be different from the one indicated for exemplary purpose.

Such heating is suitably carried out through the flame generated by the same spray gun of the apparatus, as an effect of the mixing of the propane gas and of the compressed air, or another inert gas such as for example nitrogen, fed to the front chamber 15 of the gun.

The compressed air and the liquefied petroleum gas are directed to the spray gun. The thermoplastic powders to be sprayed to the article, mixed with the cited inert transport gas, are fed to the spray gun along with the air and with the propane gas. The release of the powders is controlled by the above mentioned Venturi meter, or alternatively by the cited mixing valve.

In case the apparatus is provided with the homogenization member 40 for the flow, the thermoplastic powders transported by the inert gas run through the piping 20, passing through the homogenization member 40. Such passage gives the flow a helical motion, thus generating a vortex, and producing the effect of making uniform the distribution of the powders in the flow and to disperse possible local concentrations of powders.

Inside the spray gun, the thermoplastic powders, flowing out of the discharge chamber 7 shaped by the sleeve 8, mix with the flow of air and/or nitrogen flowing out of the coaxial discharge chamber 9, thus projecting the resulting flow 30. The powders are then expelled from the spray gun and, inside the flame, projected on the heated surface of the article to be coated. The desired melting of the powders is obtained at the contact with the heated surface of the article.

The position of the inclined holes 17, 18 enables the feeding of the flow of compressed air and/or nitrogen through the second discharge chamber 9 to cause the emission of respective flows 31, 32 converging towards the resulting flow 30, as it can be seen in FIG. 1. The resulting flow 30 therefore takes a substantially fan shape, that is relatively flattened (FIG. 1) when seen in direction perpendicular to the plane which contains the above mentioned inclined hole. Vice versa, when seen in direction parallel to the plane which contains the above mentioned inclined holes, the flow 30 has a shape with wide enlargement (FIG. 2). Such opening is determined in particular by the size of the annular sleeve 16 which extends the mixing chamber 15.

The described method and apparatus allow to carry out the prefixed scope of performing the flame spraying of thermoplastic powders, ensuring a perfect uniformity of the spraying of the powders.

Such a result is achieved by virtue of the inventive idea of directing towards the resulting flow of thermoplastic powders, flowing out of the mixing device, at least one inclined flow of compressed air and/or nitrogen to modify the shape of the resulting flow.

The fact of modifying the shape of the resulting flow of projected thermoplastic powders offers a better control on the orientation of the same projected thermoplastic powders, and thus allows to influence the uniformity of the resulting flow.

The solution providing the spraying of two flows inclined and arranged reciprocally symmetric with respect to the same resulting flow proves to be particularly advantageous, since it allows to obtain a substantially fan shaped resulting flow. Such shape allows in particular to simulate a "spatula" effect on the resulting flow, with an exit of the powders much more uniform with respect to the shape substantially conical of the resulting flow obtained with the known apparatuses.

It is to be noticed as well that changing the size of the annular sleeve which shapes the mixing chamber out of the mixing device, it is possible to adjust the opening of the obtained fan, and thus modify, at will, the size and/or the concentration of the resulting flow, according to the exigencies.

Another advantage of the apparatus according to the invention is to make the thermoplastic coating operation easier for the user, faster and with better results, in particular by virtue of the fan shape of the resulting flow of projected thermoplastic powders.

A further characteristic of the apparatus according to the invention is to provide a member for the homogenization of the flow of powders upstream of the mixing device. Such member allows to carry out a first homogenization of the flow of powders, preventing possible concentrations of powders inside the flow. It is obvious that the feeding of a homogeneous flow of powders inside the mixing device can improve the uniformity of the resulting flow outgoing from the same mixing device.

The apparatus described for indicative purpose is susceptible of numerous modifications and variants according to the different exigencies.

In practice, the embodiment of the invention, the materials used, as well as the shape and dimensions, may vary depending on the requirements.

Should the technical characteristics mentioned in each claim be followed by reference signs, such reference signs were included strictly with the aim of enhancing the understanding the claims and hence they shall not be deemed restrictive in any manner whatsoever on the scope of each element identified for exemplifying purposes by such reference signs.

The invention claimed is:

1. A method for flame spraying thermoplastic powders, the method comprising the steps of:

providing an apparatus comprising:

a spray gun predisposed to perform spraying of thermoplastic powders and to be fed with a flammable gas for producing a flame to be directed on an article to be coated in order to heat a surface of said article to a working temperature, said spray gun comprising a mixing device internally shaping separated discharge chambers, predisposed to be fed with said thermoplastic powders to be sprayed mixed to a transport inert gas, with a flow of one or more of compressed air and nitrogen and with said flammable gas, so as to direct, through a mixing chamber at an exit from said mixing device, a resulting flow of said thermoplastic powders on said heated surface, said spray gun comprising at least a couple of inclined spraying elements inclined in a way as to orient respective flows of said one or more compressed air and/or nitrogen in a direction convergent to said resulting flow of projected thermoplastic powders flowing out of the mixing device, so as to modify a shape of the resulting flow of projected thermoplastic powders giving said resulting flow a substantially flattened fan shape;

a feed means for said thermoplastic powders, associated with said mixing device;

a diffusion means for said flow of one or more of compressed air and nitrogen; and a flammable gas diffusion means for said flammable gas, said inclined spraying elements being radially arranged between said diffusion means of said flow of one or more of compressed air and nitrogen and said flammable gas diffusion means for said flammable gas heating said article to be coated at the working temperature through the flame generated by said spray gun;

mixing thermoplastic powders to be sprayed with said transport inert gas;

feeding said thermoplastic powders, transported by said transport inert gas, via said feed means through a first discharge chamber shaped inside said mixing device of said spray gun;

feeding a flow of said one or more of compressed air and nitrogen through a second discharge chamber shaped inside said mixing device;

activating said spray gun for directing said thermoplastic powders, transported by said transport inert gas, in a resulting flow, on a heated surface of said article to be coated; and spraying toward said resulting flow of directed thermoplastic powders, flowing out of said mixing device, at least a couple of flows of said one or more of compressed air and nitrogen, converging towards said resulting flow, so as to modify a shape of the resulting flow of said directed thermoplastic powders giving to said resulting flow a substantially flattened fan shape.

2. A method according to claim 1, further comprising feeding a liquefied petroleum gas through a third discharge chamber shaped inside said mixing device, to determine, in a mixing chamber in communication with said first discharge chamber, said second discharge chamber and said third discharge chamber, said flame to be directed on said article to be coated in order to carry out said heating of said article at said working temperature.

3. A method according to claim 1, wherein said at least a couple of flows of said one or more of compressed air and nitrogen originates from respective points which are axially spaced and diametrically opposite with respect to said resulting flow of directed thermoplastic powders.

4. A method according to claim 1, further comprising, between mixing the thermoplastic powders to be sprayed to said transport inert gas, and feeding the thermoplastic powders, transported by said transport inert gas, through said first discharge chamber shaped inside said mixing device of said spray gun, the step of feeding said thermoplastic powders, transported by said transport inert gas, through a homogenization member for homogenizing the flow provided with a helical axial element for giving the flow a helical motion, generating a vortex to make a distribution of the powders uniform in the flow and dissipate possible localized concentrations of powders.

5. A method according to claim 1, wherein said mixing device comprises a sleeve, a tubular element, a front flange and a body, said front flange carrying said diffusion means for said flow of one or more of compressed air and nitrogen and said flammable gas diffusion means for said flammable gas, configured to set respective discharge chambers in communication with said mixing chamber defined frontally to said front flange, said diffusion means for said flow of one or more of compressed air and nitrogen and said flammable gas diffusion means for said flammable gas being arranged along respective circumferences concentric with respect to a longitudinal axis of said tubular element, each of said inclined spraying elements comprising a through hole in said front flange and arranged in an axially distanced position with respect to said longitudinal axis of said tubular element, and at a distance, with respect to said longitudinal axis, greater with respect to a radius of a circumference whereon said diffusion means for said flow of one or more of compressed air and nitrogen is placed and smaller with respect to a radius of the circumference whereon said flammable gas diffusion means for said flammable gas is placed.

6. An apparatus for flame spraying thermoplastic powders, the apparatus comprising:

a spray gun predisposed to perform spraying of thermoplastic powders and to be fed with a flammable gas for producing a flame to be directed on an article to be coated in order to heat a surface of said article to a working temperature, said spray gun comprising a mixing device internally shaping separated discharge chambers, predisposed to be fed with said thermoplastic powders to be sprayed mixed to a transport inert gas, with a flow of one or more of compressed air and nitrogen and with said flammable gas, so as to direct, through a mixing chamber at an exit from said mixing device, a resulting flow of said thermoplastic powders on said heated surface, said spray gun comprising at least a couple of inclined spraying elements inclined in a way as to orient respective flows of said one or more compressed air and/or nitrogen in a direction convergent to said resulting flow of projected thermoplastic powders flowing out of the mixing device, so as to modify a shape of the resulting flow ofprojected thermoplastic powders giving said resulting flow a substantially flattened fan shape;

a feed means for said thermoplastic powders, associated with said mixing device;

a diffusion means for said flow of one or more of compressed air and nitrogen; and a flammable gas diffusion means for said flammable gas, said inclined spraying elements being radially arranged between said diffusion means of said flow of one or more of compressed air and nitrogen and said flammable gas diffusion means for said flammable gas.

7. An apparatus according to claim 6, wherein said inclined spraying elements are arranged in position diametrically opposite with respect to an opening for the exit of said resulting flow of projected thermoplastic powders.

8. An apparatus according to claim 6, further comprising a homogenization member upstream of said mixing device for homogenizing the flow provided with a helical axial element, through which said thermoplastic powders transported by said transport inert gas are fed before being fed to said mixing device.

9. An apparatus according to claim 6, wherein said mixing device comprises, inside a tubular shaped body, a sleeve coaxial thereto predisposed to define one of said discharge chambers of said flow of one or more of compressed air and nitrogen and axially engaged by a tubular element predisposed to define one of said discharge chambers of said thermoplastic powders, said couple of inclined spraying elements being arranged in such a way as to set said one of said discharge chambers of said flow of one or more of compressed air and nitrogen in communication with said mixing chamber.

10. An apparatus according to claim 9, further comprising a front flange associated with sealing an internal surface of the body, said front flange being shaped by an end portion of said sleeve, said front flange carrying said diffusion means for said flow of one or more of compressed air and nitrogen and said flammable gas diffusion means for said flammable gas, configured to set respective discharge chambers in communication with said mixing chamber defined frontally to the front flange, said diffusion means for said flow of one or more of compressed air and nitrogen and said flammable gas diffusion means for said flammable gas being arranged along respective circumferences concentric with respect to a longitudinal axis of said tubular element, each of said inclined spraying elements being constituted by a through hole made in said front flange and arranged in an axially distanced position with respect to the longitudinal axis of said tubular element, and at a distance, with respect to said longitudinal axis, greater with respect to a radius of a circumference whereon said diffusion means for said flow of one or more of compressed air and nitrogen is placed and smaller with respect to a radius of the circumference whereon said flammable gas diffusion means for said flammable gas is placed.

11. An apparatus according to claim 9, wherein each of said inclined spraying elements is inclined by an angle comprised between 10° and 20° with respect to said longitudinal axis of said tubular element.

* * * * *